US007403091B2

(12) United States Patent
Ishimoto et al.

(10) Patent No.: US 7,403,091 B2
(45) Date of Patent: Jul. 22, 2008

(54) INDUCTANCE COMPONENT AND MANUFACTURING METHOD THEREOF

(75) Inventors: Hitoshi Ishimoto, Osaka (JP); Nobuya Matsutani, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 156 days.

(21) Appl. No.: 10/572,059

(22) PCT Filed: Jul. 1, 2005

(86) PCT No.: PCT/JP2005/012182

§ 371 (c)(1),
(2), (4) Date: Mar. 15, 2006

(87) PCT Pub. No.: WO2006/008939

PCT Pub. Date: Jun. 26, 2006

(65) Prior Publication Data

US 2007/0030108 A1 Feb. 8, 2007

(30) Foreign Application Priority Data

Jul. 15, 2004 (JP) ..... 2004-208145

(51) Int. Cl.
*H01F 27/28* (2006.01)

(52) U.S. Cl. ..... 336/234

(58) Field of Classification Search ..... 336/65, 336/83, 212, 233–234
See application file for complete search history.

(56) References Cited

U.S. PATENT DOCUMENTS

| | | | | |
|---|---|---|---|---|
| 1,774,856 | A * | 9/1930 | Van Deventer | 336/219 |
| 4,799,115 | A * | 1/1989 | Rogers et al. | 360/66 |
| 4,959,631 | A * | 9/1990 | Hasegawa et al. | 336/83 |
| 6,067,002 | A * | 5/2000 | Fujino et al. | 336/200 |
| 6,162,311 | A * | 12/2000 | Gordon et al. | 156/89.11 |
| 6,768,409 | B2 | 7/2004 | Inoue et al. | |
| 2005/0255302 | A1 * | 11/2005 | Yang | 428/209 |

FOREIGN PATENT DOCUMENTS

| | | |
|---|---|---|
| JP | 61-053461 | 3/1986 |
| JP | 05-109314 | 7/1993 |
| JP | 2001-244124 | 9/2001 |
| JP | 2003-051419 | 2/2003 |
| JP | 2003-203813 | 7/2003 |

* cited by examiner

*Primary Examiner*—Tuyen T. Nguyen
(74) *Attorney, Agent, or Firm*—McDermott Will & Emery LLP

(57) ABSTRACT

In an inductance component including coil and multi-layered magnetic body layer formed from first metal layer, first metal magnetic body layer, middle layer including copper oxide and second metal magnetic body layer, which are piled at least on one surface of base material, first and second metal magnetic body layers and include at least one of Fe, Ni and Co and middle layer is formed from a material having specific resistance larger than that of first and second metal magnetic body layers. In accordance with such a structure, provided can be a small-sized flat inductance component superior in mass-production and used in a high frequency band.

15 Claims, 5 Drawing Sheets

Prior Art

INDUCTANCE COMPONENT AND MANUFACTURING METHOD THEREOF

RELATED APPLICATION

This application is a U.S. National Phase Application of PCT/JP2005/012182 filed on Jul. 1, 2005, which claims priority from Japanese Application No. 2004-208145 which was filed on Jul. 15, 2004 the disclosures of which Applications are incorporated by reference herein.

TECHNICAL FIELD

The present invention relates to an inductance component used in a power supplying circuit of a cellular phone and the like and a method of manufacturing the same.

BACKGROUND ART

The above kind of inductance component conventionally has a planar component structure in view of miniaturization and reduction in height. The demand for reduction in height has increased recently.

Further, eddy current should be reduced in order to correspond to a shift of a switching frequency to ahigh frequency range. As a measure to perform the above, generally known is a method of forming a laminate structure including a magnetic body layer and an insulator layer. Such a technique is disclosed in JP-A-9-55316.

FIG. 9 shows a structure of a conventional inductance component disclosed in JP-A-9-55316. In FIG. 9, the inductance component has a magnetic body layer including Fe, a laminate film of an insulator layer made of nitride of positive element having specific resistance larger than that of the magnetic body and a coil conductor part for applying a magnetic field to the magnetic body layer. That is to say, the inductance component is formed from a magnetic body layer 111 formed in a laminating process, an insulator layer 112 made of AlN or the like and a planar coil part 113, which are piled into a laminate.

The number of layers of the magnetic body layer, however, should be increased or the film thickness of each layer of the magnetic body layer should be make thicker for the purpose of securing an inductance value necessary for the power supplying circuit. In the conventional forming method, required is a laminating process using a vacuum device such as vacuum evaporation and sputtering. This causes problems that investment in plant and equipment costs high and that mass-production is difficult in view of productivity.

SUMMARY OF THE INVENTION

In order to solve the conventional problems, an object of the invention is to provide a small-sized flat inductance component superior in mass-production in inexpensive facilities and a method of the same.

The invention is an inductance component including a coil and a multi-layered magnetic body layer in which a first metal layer, a first metal magnetic body layer, a middle layer including copper oxide and a second metal magnetic body layer are piled on at least one surface of a base material. The first and second metal magnetic body layers include at least one of Fe, Ni and Co and the middle layer is formed from a material having specific resistance larger than specific resistance of the first and second metal magnetic body layers.

REFERENCE MARKS IN THE DRAWINGS

1, 11: COIL
2, 22, 23, 24: MULTI-LAYERED MAGNETIC BODY LAYER
3: BASE MATERIAL
4: FIRST METAL LAYER
5: FIRST METAL MAGNETIC BODY LAYER
6: MIDDLE LAYER
7: SECOND METAL MAGNETIC BODY LAYER
8: INSULATING LAYER
9: SECOND METAL LAYER
10*a*, 10*b*: TERMINAL PART
12: COIL INSULATION PART
13: THIRD METAL LAYER
15: THROUGH HOLE ELECTRODE
16: THROUGH HOLE PART

DETAILED DESCRIPTION OF THE PREFERRED EMBODIMENTS

Exemplary Embodiment 1

An inductance component and a method of manufacturing the same in Embodiment 1 of the invention will be described hereinafter, made reference to the drawings.

Figure 1:
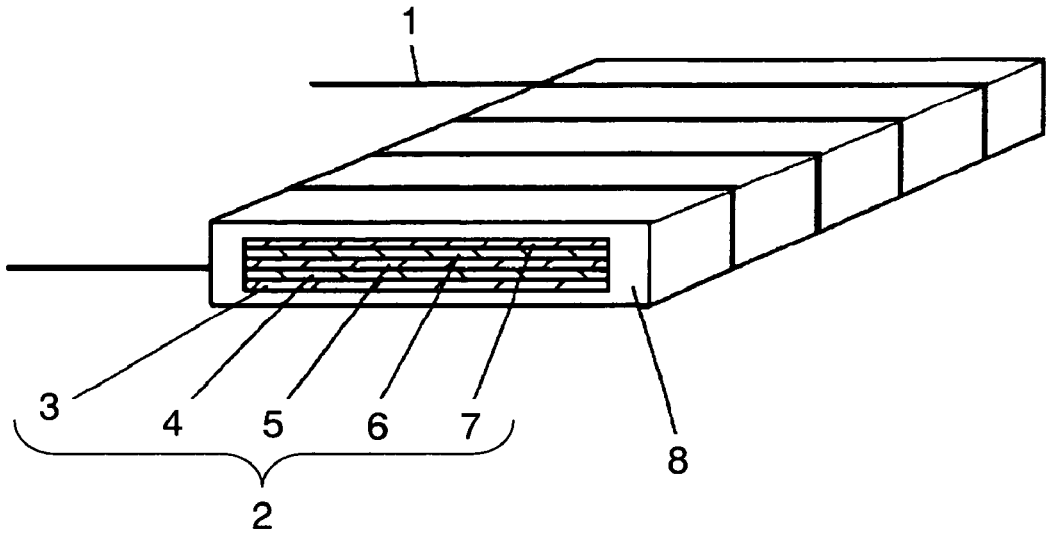
FIG. 1 is a perspective view of an inductance component in Embodiment 1 of the invention.
Figure 2:
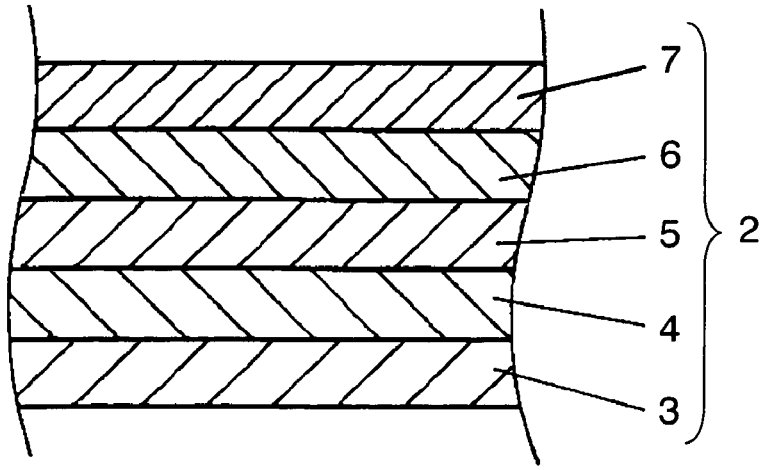
FIG. 2 is an enlarged sectional view of a multi-layered magnetic body layer of an inductance component in Embodiment 1 of the invention.

FIG. 1 shows an inductance component in Embodiment 1 of the invention. FIG. 2 is an enlarged sectional view of multi-layered magnetic body layer 2 of the inductance component shown in FIG. 1.

In FIG. 1, coil 1 is formed from a coated conducting wire using a high-conductivity material such as copper or silver and the like wound around a surface of multi-layered magnetic body layer 2. The number of the winds is not limited although four turns are given in FIG. 1.

It may be possible to provide insulator layer 8 for coating the surface of multi-layered magnetic body layer 2 by means of an insulating resin material or the like as the need arises. Insulator layer 8 prevents a circuit from being shorted in the case that an inductance component is mounted on a mounted substrate or the like. As a material for insulator layer 8, preferably used is an organic resin material such as epoxy resin, silicon resin, acrylic resin or mixture thereof. Further, inorganic filler may be mixed for the purpose of improving heat-resistance and mechanical strength.

Now, a structure of multi-layered magnetic body layer 2 will be described with reference to FIG. 2.

In FIG. 2, first metal layer 4 having conductivity is formed on at least one surface of a sheet of base material 3. First metal magnetic body layer 5 is piled on first metal layer 4. Middle layer 6 including copper oxide is further piled on first metal magnetic body layer 5. Second metal magnetic body layer 7 is then piled on middle layer 6. Multi-layered magnetic body layer 2 formed from such a laminate is thus structured.

Such a structure of multi-layered magnetic body layer 2 allows a plating process to be used for forming a film in all steps. Especially, this can be achieved by providing middle layer 6 including copper oxide. Middle layer 6 including copper oxide is characterized by specific resistance larger than that of first metal magnetic body layer 5 and second metal magnetic body layer 7 and characterized in that a plated film can be formed on the surface thereof. For middle layer 6, used is $Cu_2O$, for example. $Cu_2O$ can be formed into a film by electroplating. Second metal magnetic body layer 7 can be then formed on the $Cu_2O$ film by electroplating. As described above, first metal layer 4 is formed under first metal magnetic body layer 5 while middle layer 6 including copper oxide is formed under second metal magnetic body layer 7. This allows a plating process to be used for forming a film in all steps. Especially, the electroplating process can be used for forming first metal magnetic body layer 5 and second metal magnetic body layer 7, which require considerable film thickness in view of a magnetic characteristic, so that a production process superior in mass-production in inexpensive facilities can be achieved.

The thickness of first metal layer 4 and middle layer 6 including copper oxide is preferably designed to be thin. Accordingly, any manufacturing method has little influence on productivity.

Now, a method of forming multi-layered magnetic body layer 2 will be described.

First of all, a sheet of base material 3 is provided. Base material 3 is properly selected in view of the shape, strength, cost and reliability of an inductance component although the material of base material 3 may be formed from any material such as inorganic, organic or metal material. On at least one surface of base material 3, formed is first metal layer 4 by electroplating, electroless plating or the like. When base material 3 is formed from a metal material, base material 3 can be also used as first metal layer 4, and this allows the structure to be simplified. First metal layer 4 is provided for easily forming first metal magnetic body layer 5 by electroplating. First metal layer 4 is preferably made of metal such as Cu, which is superior in conductivity. In view of a magnetic characteristic, more preferably used is Fe, Ni or Co, which has magnetism. Accordingly, the thickness of first metal layer 4 is preferably thin when metal such as Cu having no magnetism is used.

First metal magnetic body layer 5 is then formed on first metal layer 4 by electroplating. As a material of first metal magnetic body layer 5, preferably used is a metal magnetic material in composition including at least one of Fe, Ni and Co in view of a magnetic flux density and a magnetic loss.

Middle layer 6 including copper oxide is formed on first metal magnetic body layer 5 after the above. Middle layer 6 is provided so as to separate first metal magnetic body layer from second metal magnetic body layer 7. Making the specific resistance of middle layer 6 larger than that of first and second metal magnetic body layers 5 and 7 allows an eddy current flowing over first metal magnetic body layer 5 and second metal magnetic body layer 7 to be cut off. Further, middle layer 6 including copper oxide taking a plating bath in any way allows second metal magnetic body layer 7 to be formed by electroplating. Accordingly, it is enough that copper oxide exists on at least a surface layer of middle layer 6. For the copper oxide included in middle layer 6, more suitable is $Cu_2O$ in view of film forming speed and evenness in film quality.

Thickness of middle layer 6 is preferably thin. The thickness of 1 μm of middle layer 6 is enough to give full play to its performance even when an electric current of 30 A is applied by means of a choke coil, for example.

A laminate having such a structure is referred to as multi-layered magnetic body layer 2. Insulator layer 8 made of silicon resin, epoxy resin or the like is provided for coating the surface of multi-layered magnetic body layer 2 as the need arises for the purpose of performing an insulating process. Then, using a coated copper wire to form coil 1, as shown in FIG. 1, allows an inductance component to be obtained.

Multi-layered magnetic body layer 2 is formed from layers piled on one surface of base material 3 in the above description. The layers, however, may be piled on the both surfaces of base material 3 to form multi-layered magnetic body layer 2. A suitable structure is properly selected in view of electromagnetic performance, shape, cost and the like. For example, the large thickness of a whole magnetic body layer allows an inductance component to have a large inductance value. The magnetic body layer, which is large in number of layers with the thickness of the whole magnetic body layer being constant, allows an inductance component to be superior in high frequency property. Multi-layered magnetic body layer 2 using any piling way results in the same effect.

First metal magnetic body layer 5 or second metal magnetic body layer 7 includes at least one of Fe, Ni and Co as a main component in order to achieve multi-layered magnetic body layer 2 having high saturation magnetic flux density and high permeability, which are capable of corresponding to heavy current. As a metal magnetic material for the above, used can be a magnetic alloy of Fe—Mn, Fe—Al, Fe—Si—Al and such. Composition of first and second metal magnetic body layers 5 and 7 of multi-layered magnetic body layer 2 should be not necessarily the same. The same effect can be achieved so long as at least one of Fe, Ni and Co is included as a main component.

Middle layer 6 having a ratio resistant value larger than that of first and second metal magnetic body layers 5 and 7 is effective in cutting off an eddy current flowing in both of first metal magnetic body layer 5 and second metal magnetic body layer 7. The effect is extremely remarkable when the ratio of the specific resistance values of middle layer 6 and first and second metal magnetic body layers 5 and 7 is $10^3$ or more.

Further, at least the copper oxide included in middle layer 6 improves adhesion of middle layer 6 to second metal magnetic body layer 7. It was found that good adhesion was achieved even in the case of the thickness of 10 to 20 μm of second metal magnetic body layer 7, for example.

The more the ratio of the thickness of middle layer 6 increases with respect to the whole thickness of multi-layered magnetic body layer 2, the smaller the inductance value of the inductance component becomes. Accordingly, the thickness of middle layer 6 is preferably made thinner than that of first and second metal magnetic body layers 5 and 7.

A laminate composed of middle layer 6 and second metal magnetic body layer 7 is used as a base and piled into two or more layers. This allows the laminate to be an inductance component having a larger inductance value and superior in high frequency property.

Providing an inductance component having the above-mentioned structure allows multi-layered magnetic body layer 2 to be continuously formed by plating. As a result, it is possible to provide a small-sized flat inductance component superior in mass-production in inexpensive facilities without using expensive facilities such as a vacuum evaporation or sputtering apparatus.

In the case of forming a magnetic body layer by a conventional thin film make method such as vacuum evaporation or sputtering, it is difficult to form the magnetic body layer much thick in view of strength of adhesion since the speed of forming a film is slow. In accordance with the structure according to the invention, however, a metal magnetic body layer of 10 to 20 μm can be easily formed, so that an inductance component having a large inductance value can be achieved.

Now, a method of manufacturing the inductance component will be described.

A method of manufacturing the inductance component shown in FIGS. 1 and 2 includes the following manufacturing process.

First, prepared is a polyimide film of 20 μm in thickness as base material 3, for example. An Ni layer of 0.5 μm in thickness is formed on one surface of base material 3 as first metal layer 4 by electroless plating. On first metal layer 4, formed is an Fe—Ni alloy layer of 20 μm in thickness as first metal magnetic body layer 5 by electroplating. A cuprous oxide layer is then formed on first metal magnetic body layer 5 as middle layer 6 by electrolytic plating.

On middle layer 6, formed is an Fe—Ni alloy layer of 20 μm in thickness as second metal magnetic body layer 7 by electroplating. Multi-layered magnetic body layer 2 is thus manufactured in such steps.

Repeating the film forming process for middle layer 6 and second metal magnetic body layer 7 allows multi-layered magnetic body layer 2, which is much more multi-layered, to be manufactured.

After the above, the surface of multi-layered magnetic body layer 2 is coated with epoxy resin or the like to form insulator layer 8 as the need arises. A copper wire having a diameter of 200 μm is then wound a predetermined number of turns around the surface of multi-layered magnetic body layer 2. The inductance component shown in FIG. 1 can be thus manufactured.

As described above, the inductance component in accordance with the invention can be manufactured by means of a plating apparatus, which requires comparatively inexpensive facilities, in all steps without using a thin film process such as vacuum evaporation, sputtering or the like, which requires expensive facilities.

As described above, in accordance with the inductance component and a method of manufacturing the same according to the invention, it is possible to provide a small-sized flat inductance component superior in mass-production in inexpensive facilities and a method of the same.

Exemplary Embodiment 2

An inductance component and a method of manufacturing the same in Embodiment 2 of the invention will be described hereinafter, with reference to the drawings.

Figure 3:
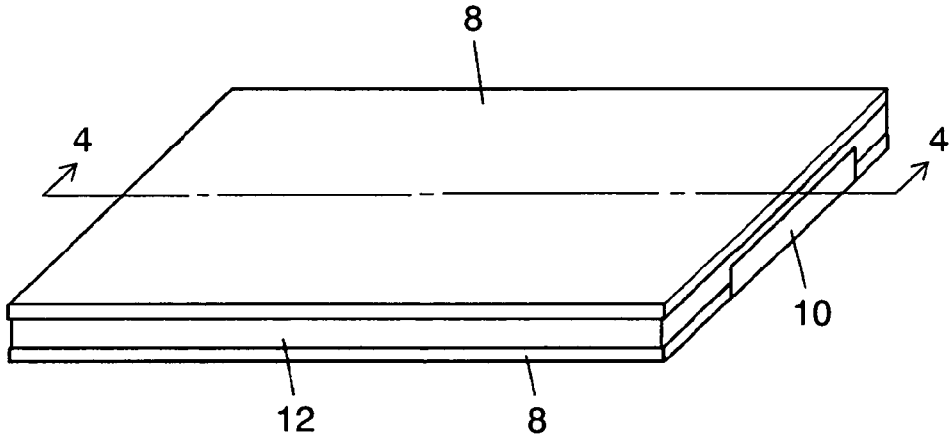
FIG. 3 is a perspective view of an inductance component in Embodiment 2 of the invention.
Figure 4:
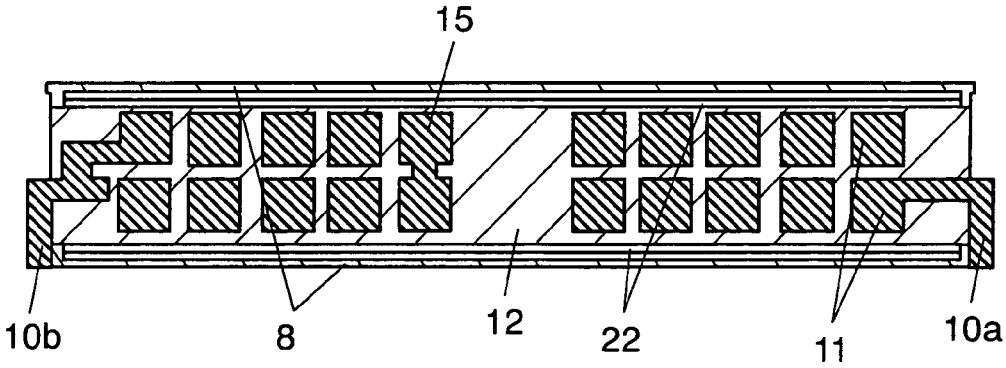
FIG. 4 is a sectional view of an inductance component in Embodiment 2 of the invention.
Figure 5:
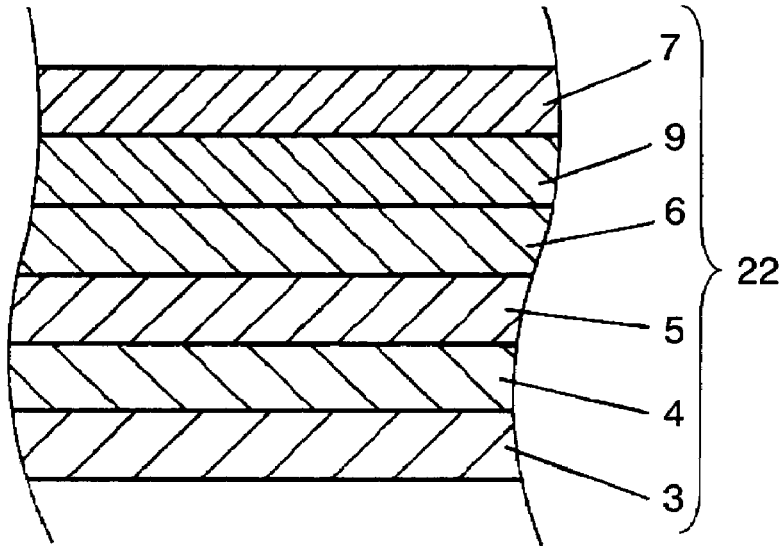
FIG. 5 is an enlarged sectional view of a multi-layered magnetic body layer of an inductance component in Embodiment 2 of the invention.

FIG. 3 is a perspective view of an inductance component in Embodiment 2 of the invention. FIG. 4 is a sectional view taken along a line 4-4 in FIG. 3. FIG. 5 is an enlarged sectional view of multi-layered magnetic body layer 22 of the inductance component in Embodiment 2 of the invention.

In FIGS. 3 and 4, coils 11 are provided so as to be built in coil insulating part 12. Coil insulating part 12 is provided for preventing coil 11 from short-circuiting.

A material having high conductivity such as copper or silver, for example, is patterned by plating or the like on coil insulating part 12 formed from a resin film or such to form coil 11. An upper line of coil 11 is formed so as to be spirally wound from a terminal part **10*b* provided on one side of the inductance component to a core part. The upper line of coil 11 is lead to a lower line of coil 11 at a center part via through hole electrode 15. The lower line of coil 11 is formed so as to be spirally and widely wound to a terminal part 10*a*** provided on the other side.

The direction in which the upper line of coil 11 is wound is the same as that of the lower line of coil 11. As a result, the upper line of coil 11 and the lower line of coil 11 do not offset magnetic flux, so that electric current flows from the upper line of coil 11 to the lower line of coil via through hole electrode 15. This allows a large inductance value to be achieved.

In another method of forming coil 11, a copper wire or a laminate metal plate is processed before providing it in coil insulating part 12 to form a coil part. The thickness (a cross section) of coil 11 should be at least 10 μm or more in order to correspond to a large amount of current although it is different according to purposes of electronics to be used. Coil 11 may be formed from one line or three or more lines other than two lines shown in FIG. 4.

Multi-layered magnetic body layers 22 are provided on the upper and lower surfaces of coil 11 having a structure described above. Providing multi-layered magnetic body layer 22 on the both surfaces allows the inductance value to be made larger.

Insulator layer 8 is for securing electric non-conductance. Accordingly, it is enough for insulator layer 8 to coat at least a surface layer of multi-layered magnetic body layer 22. Insulator layer 8 prevents the inductance component from short-circuiting when the inductance component is mounted on a mounting substrate and the like. Insulator layer 8 is preferably formed from an organic resin material such as epoxy resin, silicon resin and acrylic resin in view of productivity.

In accordance with such a structure, an eddy current generated in a direction of the thickness of multi-layered magnetic body layer 22 can be suppressed. As a result, heat generation from the inductance component can be suppressed, so that the inductance value can be increased. Forming coil 11 into the shape of a flat plate allows an inductance component shorter in height to be achieved. Further, providing coil 11 in multi-lines allows an inductance component having a sufficiently large inductance value to be achieved even when coil 11 is made flat.

Coil 11 can be formed by plating with copper or silver. Coil 11 has a square cross section. Accordingly, flat coil 11 having a high space factor can be achieved.

Especially, such a patterning technique enables a finer electrode pattern to be formed on a plane. Accordingly, an inductance component flatter than the case of the structure in Embodiment 1 can be achieved.

Now, a structure of multi-layered magnetic body layer 22 of an inductance component in Embodiment 2 of the invention will be described with reference to FIG. 5.

In FIG. 5, a basic structure of the laminate is almost the same as that of multi-layered magnetic body layer 2 of the inductance component in Embodiment 1. The difference is that second metal layer 9 is provided in FIG. 5. The copper oxide included in middle layer 6 is reduced by means of a reducing agent such as $NaBH_4$, for example, to deoxidize a surface of middle layer 6. Then, metal copper is deposited so as to form second metal layer 9 easily and at a low cost. DMAB, $LiAlH_4$ or the like can be used as a reducing agent, for example.

Providing second metal layer 9 allows evenness and film manufacturing speed of second metal magnetic body layer 7 as well as adhesion of middle layer 6 to second metal magnetic body layer 7 to be improved.

Further, multi-layered magnetic body layer 22 in which a laminate formed from middle layer 6, second metal layer 9 and second metal magnetic body layer 7 is piled into two or more layers enables the inductance value to be increased. Moreover, providing laminated films on the both surfaces of base material 3 allows an inductance component having a large inductance value to be achieved. The same effect can be achieved no matter how multi-layered magnetic body layer 22 is piled so long as the structure is the same.

In Embodiment 2, it is also possible to obtain a magnetic body layer having high saturation magnetic flux density and high permeability when first and second metal magnetic body layers 5 and 7 include at least one of Fe, Ni and Co as a main component. Composition of first and second metal magnetic body layers 5 and 7 of multi-layered magnetic body layer 22 should be not necessarily the same. The effect can be achieved so long as at least one of Fe, Ni and Co is included as the main component.

A method of manufacturing the inductance component having the above mentioned structure in Embodiment 2 of the invention will be described hereinafter.

Coil 11 of the inductance component in Embodiment 2 of the invention can be manufactured in the following manufacturing process. First, a resist film is formed on a substrate such as a polyimide film so as to be a coil pattern of the lower line of coil 11. Metal having high conductivity such as copper or silver is then provided on the substrate by plating to be tens of micrometers in thickness to form a coil pattern of the lower line of coil 11. After the above, a resist film is provided again on the formed coil pattern of the lower lines of coil 11. A hole is provided by etching or the like in advance at a place where through hole electrode 15 is formed. A resist film for forming a coil pattern of the upper line of coil 11 is then formed. On the substrate with the formed resist film, formed is the coil pattern of the upper line of coil 11 by plating the substrate with metal such as copper or silver to tens of micrometers in thickness. The coil pattern of the upper line is then coated. Coil 11 in the shape of a sheet shown in FIG. 4 can be thus manufactured through the above-mentioned steps.

Following to the above, multi-layered magnetic body layer 22 is formed on coil 11 in the shape of a sheet, which is formed as described above. A basic step of manufacturing multi-layered magnetic body layer 22 is almost the same as the step of Embodiment 1. The difference is that second metal layer 9 is provided on middle layer 6. Accordingly, the manufacturing step of components until middle layer 6 is the same as that of Embodiment 1, and therefore, is omitted from description.

After forming middle layer 6 as shown in FIG. 5, at least a surface of middle layer 6 is reduced by means of a reducing agent such as $NaBH_4$ to form a metal copper layer as second metal layer 9. On second metal layer 9, formed is second metal magnetic body layer 7 by electroplating. Providing second metal layer 9 as described above allows second metal magnetic body layer 7 to be formed evenly in film quality and the film forming speed to be increased. Further, such a structure allows the inductance component according to the invention to be efficiently manufactured with a large-sized base material 3.

Moreover, a step of piling a laminate composed of middle layer 6, second metal layer 9 and second metal magnetic body layer 7 into two or more layers as the need arises allows a method of manufacturing an inductance component having a larger inductance value to be provided. Multi-layered magnetic body layer 22 in which laminated films are formed on the both surfaces of base material 3 can be also manufactured as well.

It may be possible to form second metal layer 9 by plating. The same effect can be achieved as long as the structure is the same even in the case that multi-layered magnetic body layer 22 is piled in a way other than the above.

As described above, in accordance with the structure of the inductance component in Embodiment 2 of the invention, it is possible to provide an inductance component in which a loss due to an eddy current is little even in the case of operation in a high frequency range, in which the adhesion is improved, which has a sufficient inductance value even when it is formed into a small-sized flat shape and which is superior in mass-production.

Exemplary Embodiment 3

An inductance component and a method of manufacturing the same in Embodiment 3 of the invention will be described hereinafter, with reference to the drawings.

Figure 6:
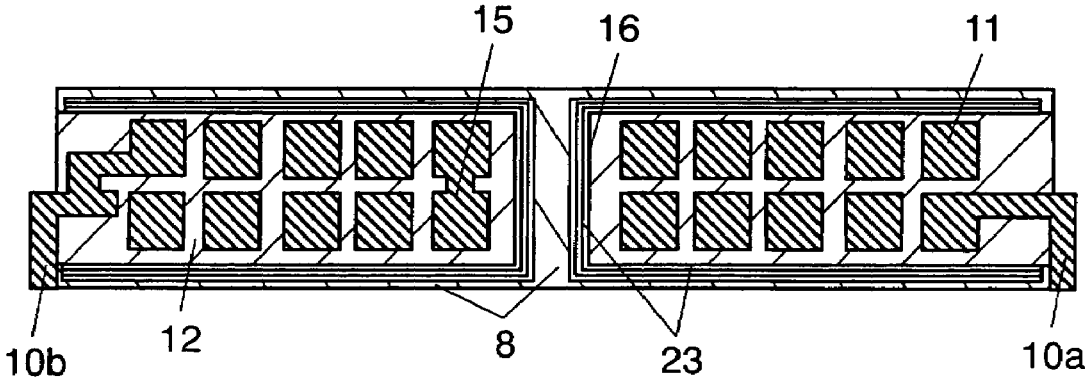
FIG. 6 is a sectional view of an inductance component in Embodiment 3 of the invention.
Figure 7:
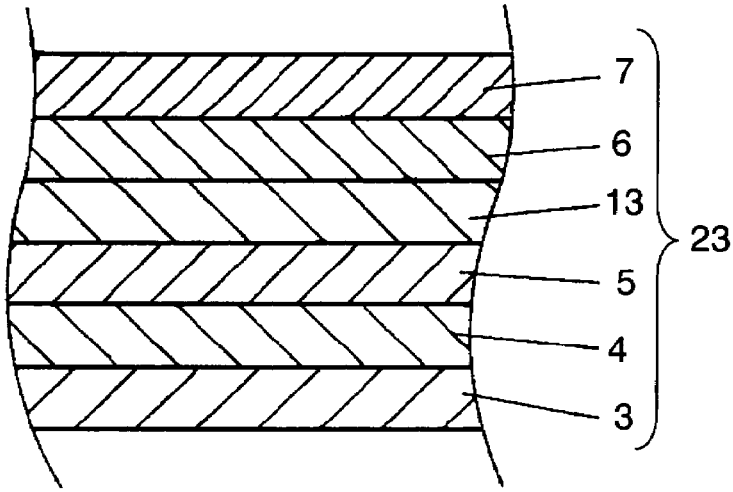
FIG. 7 is an enlarged sectional view of a multi-layered magnetic body layer of an inductance component in Embodiment 3 of the invention.

FIG. 6 is a sectional view of an inductance component in Embodiment 3 of the invention. FIG. 7 is an enlarged sectional view of a multi-layered magnetic body layer of the inductance component in Embodiment 3 of the invention.

In FIGS. 6 and 7, a structure and a forming method of coil 11 are the same as those of Embodiment 2, and therefore, are omitted from description. The difference from FIG. 4 of Embodiment 2 is that through hole part 16 is provided in a core part of coil 11. Through hole part 16 is provided on its inner wall with multi-layered magnetic body layer 23. As a result, multi-layered magnetic body layers 23 separately provided on the upper and lower surfaces of coil 11 are connected via multi-layered magnetic body layer 23 provided on the inner wall of through hole part 16.

Such a structure contributes to remove a magnetic gap and to reduce a leakage flux. Further, an inductance component having a large inductance value can be achieved. A gap in through hole part 16 is filled with insulator layer 8 in FIG. 6. The gap, however, may be filled with a magnetic body. In this case, a magnetic characteristic is further improved.

On the surface of multi-layered magnetic body layer 23, provided is insulator layer 8. Insulator layer 8 is provided for preventing a short circuit. An inorganic material, an organic material and a compound of the above are preferable for insulator layer 8.

Multi-layered magnetic body layer 23 can be integrally formed by plating. This allows an inductance component superior in mass-production to be provided. For example, it is difficult to form multi-layered magnetic body layer 23 in through hole part 16, which has a diameter of 1 mm or less and a depth of 0.1 mm or more, by sputtering or evaporation. Using plating, however, allows the inductance component to be easily formed.

Now, a structure of multi-layered magnetic body layer 23 of the inductance component in Embodiment 3 of the invention will be described in detail, with reference to FIG. 7.

In FIG. 7, a basic structure of multi-layered magnetic body layer 23 of the inductance component in Embodiment 3 of the invention is almost the same as the structure described with respect to Embodiment 1. Accordingly, only a different point will be described. In multi-layered magnetic body layer 23 of the inductance component in Embodiment 3, third metal layer 13 is provided on first metal magnetic body layer 5. Such a structure improves adhesion of first metal magnetic body layer 5 to middle layer 6.

An operation of the above will be now described. When an Fe—Ni alloy is formed into a film on first metal magnetic body layer 5, for example, an extremely small quantity of oxide of iron is deposited on a surface of first metal magnetic body layer 5. Generation of the oxide of iron sometimes causes deterioration in adhesion of first metal magnetic body layer 5 to middle layer 6 formed on first metal magnetic body layer 5. On the other hand, the oxide of iron is reduced to metal iron when third meal layer 13 is formed from nickel or such by plating. This allows adhesion of first metal magnetic body layer 5 to third metal layer 13 to be improved, and thereby, adhesion of middle layer 6 formed thereon to be also improved.

Furthermore, piling a laminate formed from third metal layer 13, middle layer 6 and second metal magnetic body layer 7 into two or more layers enables the inductance value to be increased.

A method of manufacturing the inductance component having such a structure will be described below.

A basic step of manufacturing the inductance component in Embodiment 3 is almost the same as that of Embodiment 2. Accordingly, only a different point will be described.

After forming coil 11 in the shape of a sheet in Embodiment 2, through hole part 16 is formed in a core part of coil 11 in a process of making a hole by means of a puncher, a laser beam or the like. Multi-layered magnetic body layer 23 is provided on the inner wall of through hole part 16 as well as on the upper and lower surfaces of coil 11. Providing multi-layered magnetic body layer 23 on the inner wall of through hole part 16 allows multi-layered magnetic body layer 23 to be formed in one body from the upper surface to the lower surface of coil 11.

Third metal layer 13 on first metal magnetic body layer 5 is formed from copper, nickel or the like, which is formed into a film on first metal magnetic body layer 5 by plating. The other steps of the manufacturing method are the same as those of Embodiment 2.

As described above, in accordance with the method of manufacturing an inductance component in Embodiment 3, a small-sized flat inductance component further superior in adhesion can be manufactured.

Exemplary Embodiment 4

An inductance component in Embodiment 4 of the invention will be described hereinafter, with reference to the drawings.

Figure 8:
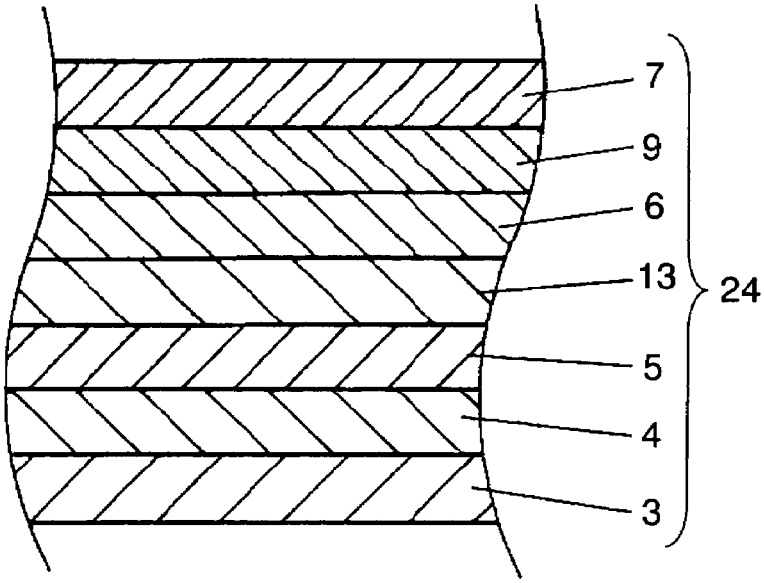
FIG. 8 is an enlarged sectional view of a multi-layered magnetic body layer in Embodiment 4 of the invention.
Figure 9:
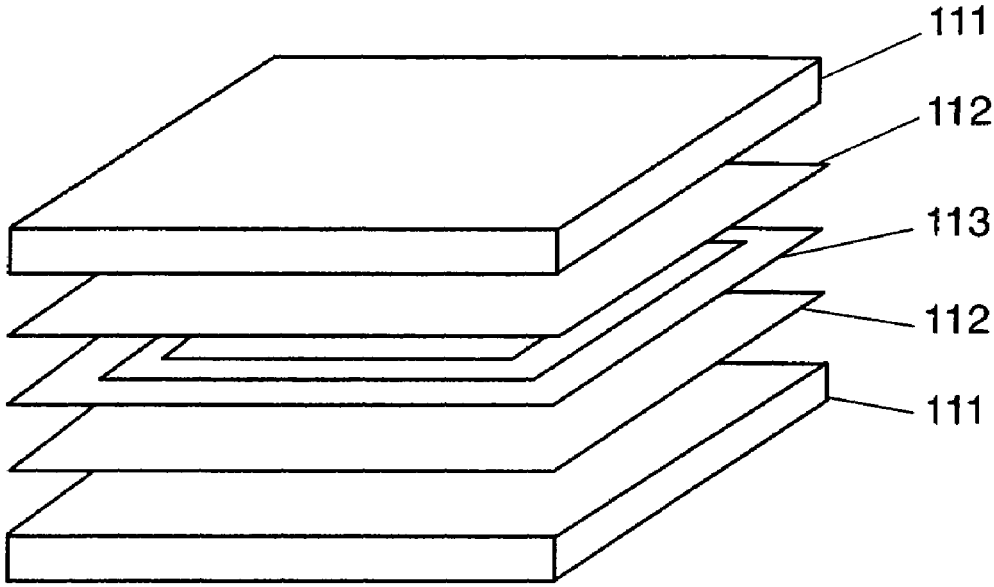
FIG. 9 is an exploded perspective view of a conventional inductance component.

FIG. 8 is an enlarged sectional view of multi-layered magnetic body layer 24 of the inductance component in Embodiment 4 of the invention. A basic structure of the inductance component in Embodiment 4 is almost the same as that of the inductance component in Embodiment 3. The difference lies in a laminate structure of multi-layered magnetic body layer 24. In FIG. 8, a point different from multi-layered magnetic body layer 23 in FIG. 7 is that second metal layer 9 is further provided on middle layer 6.

Such a structure allows multi-layered magnetic body layer 24 to be superior in adhesion of first metal magnetic body layer 5, middle layer 6 and second metal magnetic body layer 7. Accordingly, it is possible to provide a small-sized flat inductance component further superior in reliability.

In addition, multi-layered magnetic body layer 24 in which a laminate formed from third metal layer 13, middle layer 6, second metal layer 9 and second metal magnetic body layer 7 is piled into two or more layers enables an inductance component having a larger inductance value to be achieved.

A method of manufacturing the inductance component having the structure described above can be achieved by combining the manufacturing processes described in Embodiments 2 and 3.

INDUSTRIAL APPLICABILITY

As described above, in the inductance component according to the invention, a loss due to an eddy current is little even in the case of operation in a high frequency range and adhesion of a magnetic body layer and a middle layer in a multi-layered magnetic body layer is high. The method of manufacturing the inductance component, which is superior in mass-production, allows an inductance component superior in reliability and having a sufficient inductance even when it is formed into a small-sized flat body to be obtained. Accordingly, the invention is applicable to production of an inductance component used for a telephone circuit of a cellular phone, for example.

The invention claimed is:

1. An inductance component including:

a coil; and a multi-layered magnetic body layer, said multi-layered magnetic body layer including:

a first metal layer, a first metal magnetic body layer, a middle layer including copper oxide and a second metal magnetic body layer are piled on a base material, wherein the first and second metal magnetic body layers include at least one of Fe, Ni and Co and the middle layer is formed from a material having specific resistance larger than specific resistance of the first and second metal magnetic body layers.

2. The inductance component of claim 1, wherein the multi-layered magnetic body layer is formed from a laminate including the middle layer and the second metal magnetic body layer, the laminate piled into two or more layers.

3. The inductance component of claim 1, wherein the first metal layer includes at least one of Cu, Fe, Ni and Co.

4. The inductance component of claim 1, wherein the multi-layered magnetic body further includes a second metal layer between the middle layer and the second metal magnetic body layer.

5. The inductance component of claim 4, wherein the multi-layered magnetic body layer is formed from a laminate including the middle layer, the second metal layer and the second metal magnetic body layer, the laminate piled into two or more layers.

6. The inductance component of claim 4, wherein the first metal layer and the second metal layer include at least one of Cu, Fe, Ni and Co.

7. The inductance component of claim 1, wherein the multi-layered magnetic body further includes a third metal layer between the first metal magnetic body layer and the middle layer.

8. The inductance component of claim 7, wherein the multi-layered magnetic body layer is formed from a laminate including the third metal layer, the middle layer and the second metal magnetic body layer, the laminate piled into two or more layers.

9. The inductance component of claim 7, wherein the multi-layered magnetic body layer further includes a second metal layer between the middle layer and the second metal magnetic body layer.

10. The inductance component of claim 9, wherein the multi-layered magnetic body layer is formed from a laminate including the third metal layer, the middle layer, the second metal layer and the second metal magnetic body layer, the laminate piled into two or more layers.

11. The inductance component of claim 7, wherein the first metal layer, the second metal layer and the third metal layer include at least one of Cu, Fe, Ni and Co.

12. The inductance component of claim 1, further comprising:

a through hole part formed in a core part of the coil, wherein the multi-layered magnetic body layer is provided continuously on an inner wall of the through hole part and on upper and lower surfaces of the coil.

13. The inductance component of claim 1, wherein the copper oxide included in the middle layer is $Cu_2O$.

14. The inductance component of claim 1, wherein the top surface of the multi-layered magnetic body layer is coated with an insulator layer.

15. The inductance component of claim 1, wherein the base material and the first metal layer are made of the same metal.

* * * * *